US006705755B1

(12) United States Patent
Innings et al.

(10) Patent No.: US 6,705,755 B1
(45) Date of Patent: Mar. 16, 2004

(54) METHOD OF HOMOGENIZATION

(75) Inventors: Fredrik Innings, Malmo (SE); Rolf Malmberg, Lund (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 09/787,201

(22) PCT Filed: Sep. 13, 1999

(86) PCT No.: PCT/SE99/01593

§ 371 (c)(1),
(2), (4) Date: Aug. 15, 2001

(87) PCT Pub. No.: WO00/15327

PCT Pub. Date: Mar. 23, 2000

(30) Foreign Application Priority Data

Sep. 15, 1998 (SE) ..... 9803124

(51) Int. Cl.[7] ..... B01F 5/06
(52) U.S. Cl. ..... 366/176.1; 137/625.33
(58) Field of Search ..... 366/176.1, 340, 366/162.5, 162.4; 137/625.33

(56) References Cited

U.S. PATENT DOCUMENTS 1,496,658 A * 6/1924 Knollenberg ..... 366/176.1
2,882,025 A * 4/1959 Loo ..... 366/176.1
3,219,063 A * 11/1965 Schumann et al. .... 137/625.33
3,853,268 A * 12/1974 Schneider ..... 137/625.33
4,233,320 A 11/1980 Monaco et al.
4,300,595 A * 11/1981 Mayer et al. ..... 137/625.33
5,482,369 A 1/1996 Verstallen
6,234,206 B1 5/2001 Malmberg et al.

* cited by examiner

*Primary Examiner*—Tony G. Soohoo
(74) *Attorney, Agent, or Firm*—Burns, Doane, Swecker & Mathis, L.L.P.

(57) ABSTRACT

The invention relates to a method of homogenization of a pressured liqueform emulsion, such as milk. The liquid is caused to pass at least two concentrically placed homogenization gaps (12, 13) which are form in the space between two narrow surface (10, 11)on a fixed valve seat (2) and two narrow surfaces (14, 15) on a movable valve cone (1). When the liquid passes out the homogenization gaps (12, 13) a first homogenization takes place. The homogenization is rendered more efficient in that the liquid, when it passes out from one of the homogenization gaps (12) at high speed and in a restricted space meets the liquid out from one or more of the other homogenization gaps (13).

8 Claims, 2 Drawing Sheets

METHOD OF HOMOGENIZATION

TECHNICAL FIELD

The present invention relates to a method of homogenization of a pressurised liqueform emulsion, in which the liquid is caused to pass at least two concentrically placed homogenization gaps.

BACKGROUND ART

Homogenization is an industrial process which has long been employed and whose purpose is, in a fat emulsion such as, for example, milk, to shear or split the largest fat globules into smaller fat globules and by such means stabilize the fat emulsion. For, for example, milk, this implies that cream-clotting is prevented, and the vast majority of all consumer milk today is homogenized.

Homogenization normally takes place by mechanical processing, such that the fat emulsion, which is at a high infeed pressure, is forced at high speed to pass through a very narrow gap where the fat globules of the fat emulsion are broken up as a result of the turbulence which occurs at high speeds and by means of cavitation bubbles which implode in the liquid. The process takes place during a very short period of time and what happens during this brief period is that the speed of the fat emulsion on its passage increases while the pressure drops, which results in the liquid coming to the boil.

A homogenizer substantially consists of a large piston pump which gives high pressure, and a counter-pressure device where the homogenization proper takes place. The counter-pressure device, the homogenizer valve in turn consists of a pressurised, resilient valve cone, a valve seat and a valve housing which surrounds the valve cone and the valve seat. The valve cone and the valve seat are normally rotation-symmetric and are disposed such that between these parts, a radial throttle occurs which constitutes a homogenization gap. The height, width and length of the gap determine the volume at which the homogenization takes place. This volume must be as slight as possible in order to obtain an efficient homogenization. The gap height is reduced at an elevated pressure on the liquid which is to be homogenized, at the same time as a greater flow entails that the gap height is increased.

It is often desirable today to employ a lower pressure on the liquid, at the same time as the intention is to increase the flow volume. This implies that a longer homogenization gap is needed. Various methods for lengthening the homogenization gap are known from the patent literature. Swedish Patent Application SE 9701504-4 discloses a homogenization valve in which a number of homogenization gaps are concentrically disposed, which thereby gives an increased length of the homogenization gap.

Most generally, it is insufficient merely to extend the homogenization gap. In order to obtain as efficient homogenization as possible, where all fat globules, for example in milk, are sheared or split into such small fat globules that a stable emulsion is obtained. This problem has most generally been solved by carrying out the homogenization process in several stages.

U.S. Pat. No. 5,482,369 discloses a further method of obtaining an efficient homogenization. This method takes as its point of departure that the component parts or phases of the emulsion, for example water and fat which are both under pressure, are caused to pass through two opposed nozzles so that the two jets meet at high speed. The two nozzles are fixed and have a very narrow gap where the two liquids are to pass Milk, which already from the outset consists of a mixed, unstable fat emulsion which may contain naturally occurring particles would, in such a homogenizer, rapidly block the narrow gaps of the nozzles and render the process unusable.

OBJECT OF THE INVENTION

One object of the present invention is to realise a homogenization gap which is of optimum design and is controllable for desired flow and pressure, at the same time as a more efficient and improved homogenization is obtained by utilising the speed at which the liquid passes the homogenization gap.

SOLUTION

This and other objects have been attained according to the present invention in that the method of homogenization of the type described by way of introduction has been given the characterizing feature that the liquid, when passing out from one of the homogenization gaps at high speed and in a restricted space, meets the liquid out from one or more of the other homogenization gaps.

Preferred embodiments of the present invention have further been given the characterizing features as set forth in the appended subclaims.

BRIEF DESCRIPTION OF THE ACCOMPANYING DRAWINGS

One preferred embodiment of the present invention will now be described in greater detail hereinbelow, with particular reference to the accompanying Drawings, in which.

The Drawings show only those details and parts essential to an understanding of the present invention, and the placing of the homogenization valve in the complete homogenizer, which is well-known to a person skilled in the art has been omitted.

DESCRIPTION OF PREFERRED EMBODIMENT

Figure 1:
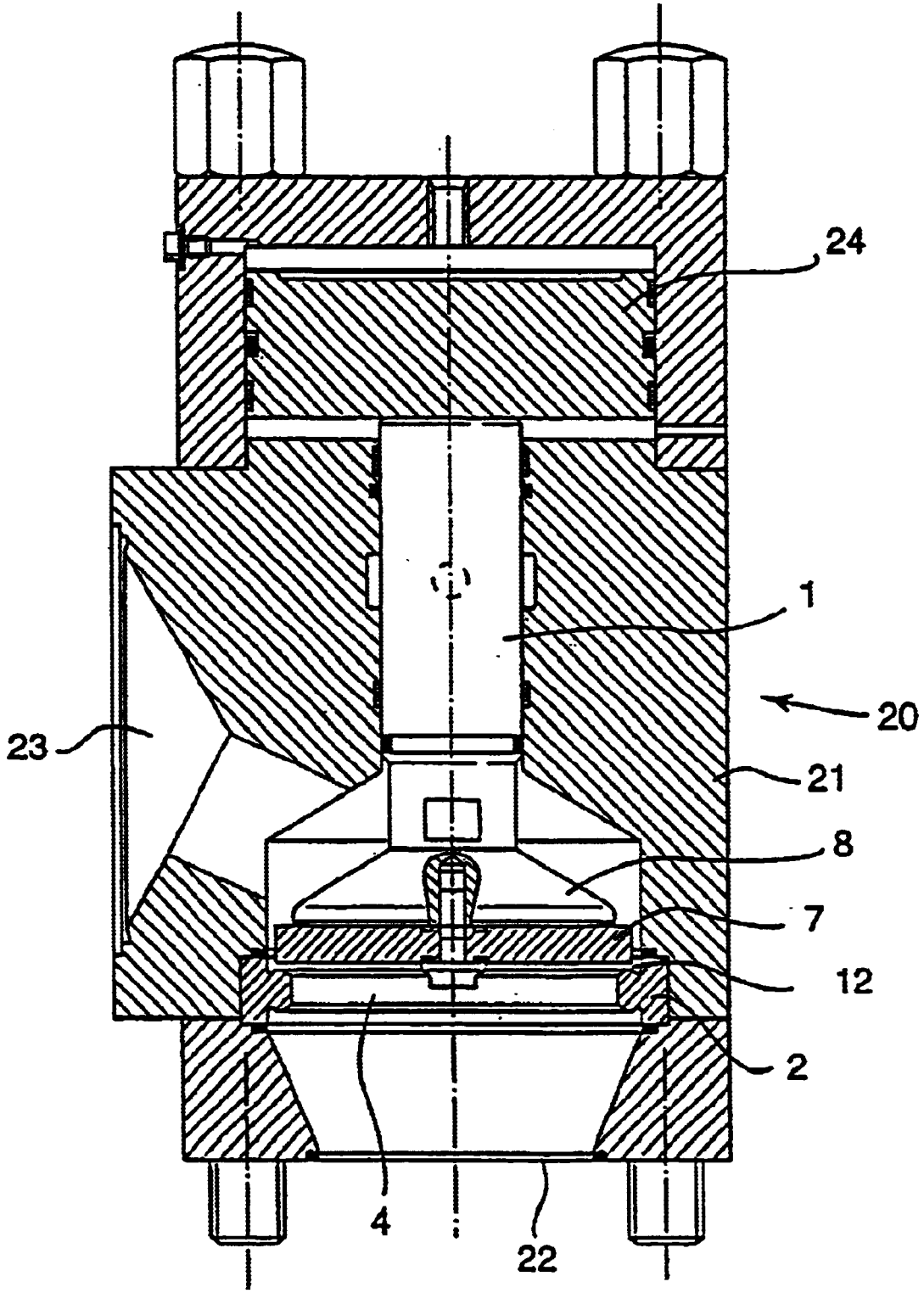
FIG. 1 shows, partly in section, a conventional homogenization valve.

A homogenization valve 20 of conventional type is shown in FIG. 1, the homogenization valve 20 substantially consists of a valve housing 21 with an inlet 22 and an outlet 23 for the liquid which is to be homogenized, as well as a movable valve cone 1 and a fixed valve seat 2.

Figure 2:
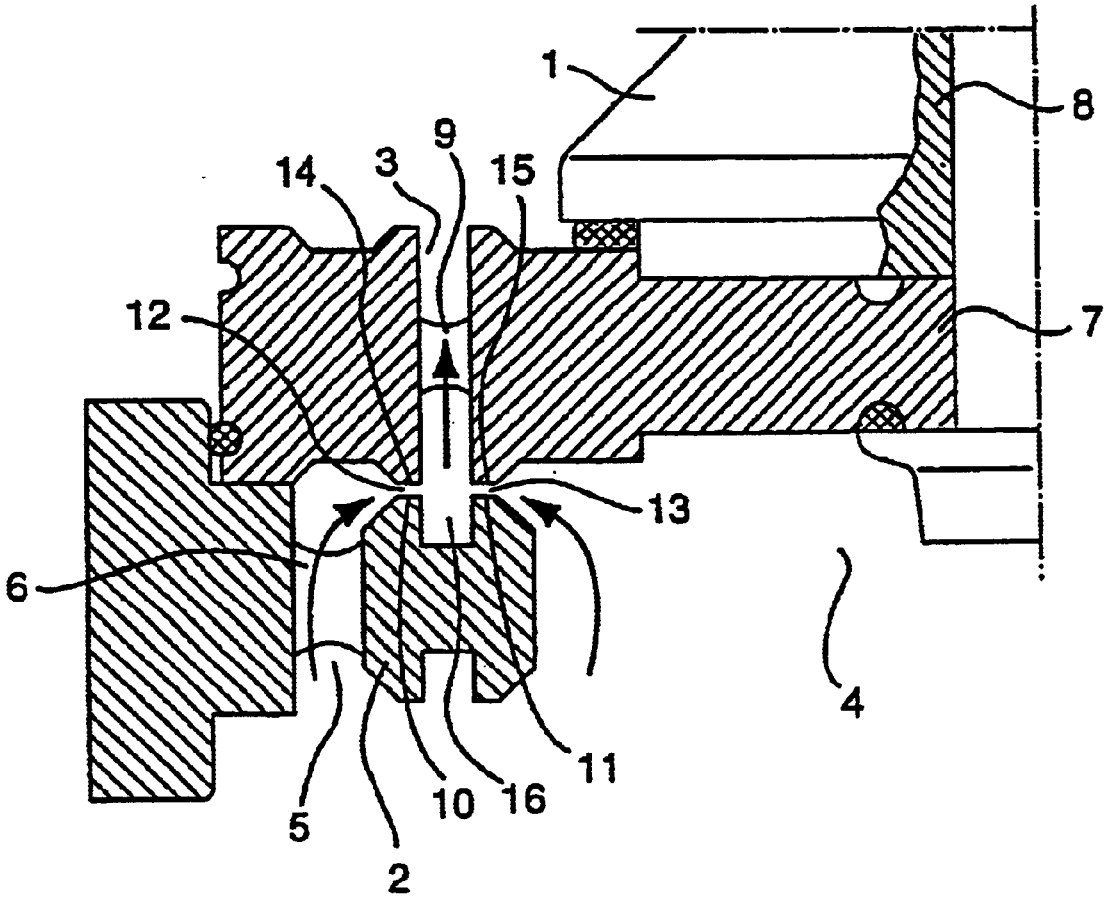
FIG. 2 shows, partly in section, a part of a homogenization valve in which the method according to the present invention may be reduced into practice.

A part of a homogenization valve 20 of the type in which the method according to the present invention may be reduced into practice is shown in FIG. 2. In the preferred embodiment, the valve seat 2 is rotation-symmetric and has a central throughflow channel 4 for the liquid which is to be homogenized. The through channel 4 constitutes an extension of the inlet 22 of the homogenization valve 20. From a central plane, the valve seat 2 is designed so that it is identical on both sides of the central plane and is, thus, reversible in the valve housing 21, which implies a doubled service life for the valve seat 2.

In addition to the central throughflow channel 4, the valve seat 2 has a throughflow channel 5 for the liquid which is to be homogenized. Along its extent, the throughflow channel 5 has a number of narrow connection bridges 6 which hold together the two concentric parts of the valve seat 2.

The valve cone 1, which is also rotation-symmetric, is pressurised, normally by a hydraulic or pneumatic piston 24, but may, in simpler versions, be pressurised by means of a grub screw which acts via a spring. The valve cone 1 is also movable, for example, via the oil in the cylinder, in order to absorb the rapid flow variations which occur in the liquid which is to be homogenized. This elasticity is necessary in order to handle the flow variations that naturally occur in piston pumps.

The valve cone 1 in the preferred embodiment is designed such that the lower region facing towards the valve seat 2 consists of a separate part 7, this part 7 being secured on a central part 8 of the valve cone 1. From a central plane, the part 7 is designed so that it is identical on both sides of the central plane and is, thus, reversible, which implies a doubled service life for the part 7 of the valve cone 1.

In the lower part 7 of the valve cone 1, there is provided a throughflow channel 3. Along its extent, the throughflow channel 3 has a number of narrow connection bridges 9 which hold together the two concentric parts of the part 7 of the valve cone 1.

On the valve seat 2, there are at least two narrow, planar surfaces 10 and 11 which each constitute one side of a homogenization gap 12, 13. Additional homogenization gaps 12, 13 may also occur pairwise and concentrically placed, but a homogenization valve 20 with more than four homogenization gaps 12, 13 would probably be difficult to manufacture.

On the valve cone 1, there are likewise two narrow, planar surfaces 14, 15 which each constitute the other side of the homogenization gaps 12 and 13. The surfaces 10, 11, 14, 15, respectively are placed in register and in spaced apart relationship to one another, this being designated gap height and is normally 50–200 $\mu$m. The gap height may be varied with varied pressure and flow, in that the valve cone 1 is moved closer to or further away from the valve seat 2.

The distance between the two homogenization gaps 12 and 13 is the same as the width of the throughflow channel 3. The throughflow channel 3 may have a slight extension 16 provided in the valve seat 2. Alternatively, the valve cone 1 has a completely straight side which consists of the surfaces 10 and 11 and their extension. The surfaces 10, 14 and 11, 15, of the homogenization gaps 12 and 13, respectively should be completely straight in order the better to guide the liquid through the homogenization gaps 12 and 13.

The liquid, normally milk, which is to be homogenized is led into the homogenizer and is there pressurised at approximately 10–25 Mpa. The milk normally has a fat content of 0.5–3.5 per cent and is at a temperature of 55–80° C.

The liquid is led in through the inlet of the homogenization valve 20 and when it reaches the valve seat 2 the liquid is distributed so that it partly passes through the central throughflow channel 4 and partly through the channel 5. Thereafter, the liquid passes through each respective homogenization gap 12 and 13 and a fist part of the homogenization takes place. In the passage, a very rapid pressure drop down to 0 Mpa is obtained, at the same time as the speed of liquid increases, which results in the liquid beginning to boil.

When the liquid from the two homogenizing gaps 12 and 13 departs from the gaps 12 and 13, they will meet at high speed in a second part of the homogenization. This contributes to a large extent in improving the homogenization. Once the two flows have converged together, the speed reduces and the pressure once again increases. The liquid stops boiling and the steam bubbles in the liquid implode. The entire process takes place during a few fractions of a second, and in the violent process where the high speed and converging of the two flows into one another give rise to turbulence and cavitation, the fat globules which are to be found in the liquid are sheared or split into smaller particles or globules.

The process takes place in a restricted space, i.e. between the outlets from the two homogenization gaps 12, 13 and partly in the throughflow channel 3, as well as possibly in its extension 16. Thereafter, the ready homogenized liquid passes out through the throughflow channel 3 and departs from the homogenization valve 20 through its outlet 23.

Given that the gap height for the homogenization gaps 12, 13 may be varied, it is possible, on washing of the homogenization valve 20, to increase the distance between the valve cone 1 and the valve seat 2 and thereby obtain easily washed surfaces. Given that the valve seat 2 and the part 7 of the valve cone 1 have hygienic sealings against the valve housing 21 and the part 8 of the valve cone 1, a hygienic homogenization valve 20 will be obtained which satisfies the requirements of the food industry and which may be washed using conventional equipment.

As will have been apparent from the foregoing description, a method of homogenization is realised which combines conventional homogenization with counter-directed flows, which considerably improves the homogenization process. 1 that it is the homogenization gaps that create the counter-directed flows, problems which fixed nozzles entail are obviated in respect of the homogenization of milk The present invention should not be considered as restricted to that described above and shown on the Drawings, many modifications being conceivable without departing from the scope of the appended claims.

What is claimed is:

1. A method of homogenization of a pressurised liqueform emulsion comprising pressurizing a liquid to a pressure of approximately 10–25 MPa causing the pressurized liquid to pass at least two concentrically placed homogenization gaps thereby subjecting the liquid to a first part of the homogenization, wherein the liquid, when passing out from one of the homogenization gaps at high speed flow created by a rapid pressure drop from the approximately 10–25 MPa down to approximately 0 MPa and into a restricted space, meets the liquid from one or more of the other homogenization gaps, whereby the liquid is subjected to a second part of the homogenization in the restricted space as a result of turbulence created by the converging high speed flows of liquid, wherein the at least two concentrically placed homogenization gaps are adjacent the restricted space.

2. The method as claimed in claim 1, wherein the homogenization gaps are created in the space between two surfaces on a valve seat, and two narrow surfaces on a valve cone.

3. The method as claimed in claim 2, wherein the liquid is led into the homogenization gaps through a central throughflow channel and a concentric throughflow channel which are provided in the valve seat.

4. The method as claimed in claim 2, wherein the liquid departs from the homogenization gaps via a throughflow channel provided in the valve cone.

5. A method of homogenization of a pressurized liqueform emulsion, comprising the steps of:

pressurizing a liquid to a pressure of approximately 10–25 MPa;

passing the pressurized liquid through at least two concentrically placed homogenization gaps thereby subjected the liquid to a first part of the homogenization; and dispensing the liquid from the at least two concentrically placed homogenization gaps into a restricted space and at a high speed flow created by a rapid pressure drop from the approximately 10–25 Mpa down to approximately 0 MPa whereby the liquid is subjected to a second part of the homogenization in the restricted space as a result of turbulence created by the converging high speed flows of liquid wherein the at least two concentrically placed homogenization gaps are adjacent the restricted space.

6. The method as claimed in claim 5, wherein the at least two homogenization gaps are created in the space between two surfaces on a valve seat, and two narrow surfaces on a valve cone.

7. The method as claimed in claim 6, wherein the liquid is led into the at least two homogenization gaps through a central throughflow channel and a concentric throughflow channel which are provided in the valve seat.

8. The method as claimed in claim 6, wherein the liquid departs from the homogenization gaps via a throughflow channel provided in the valve cone.

* * * * *